US005339964A

United States Patent [19]

Gray et al.

[11] Patent Number: 5,339,964

[45] Date of Patent: Aug. 23, 1994

[54] METHOD AND APPARATUS FOR USING PASSIVE EXHAUST FOR PNEUMATIC SORTING SYSTEM

[75] Inventors: Calvin G. Gray, Medford; Frank B. Thomason, Grants Pass, both of Oreg.

[73] Assignee: SIMCO/Ramic Corporation, Medford, Oreg.

[21] Appl. No.: 124,404

[22] Filed: Sep. 20, 1993

[51] Int. Cl.[5] ..... B07C 5/00

[52] U.S. Cl. ..... 209/587; 209/639; 209/644; 198/493

[58] Field of Search ..... 209/580, 587, 639, 644, 209/939; 198/493; 406/79, 82, 168, 175

[56] References Cited

U.S. PATENT DOCUMENTS

| | | | |
|---|---|---|---|
| 1,655,574 | 1/1928 | Stebbins | 209/154 |
| 1,655,576 | 1/1928 | Stebbins | 209/154 |
| 2,105,589 | 1/1938 | Eades | 226/109 |
| 3,097,161 | 7/1963 | Dudyak | 209/12 |
| 3,097,744 | 7/1963 | Hutter et al. | 209/111.5 |
| 3,179,247 | 4/1965 | Hutter et al. | 209/74 |
| 3,384,233 | 5/1968 | Bolles | 209/12 |
| 3,405,820 | 10/1968 | Mori | 214/17 |
| 3,757,946 | 9/1973 | Berkowitz et al. | 209/639 |
| 3,908,720 | 9/1975 | Garnett | 141/93 |
| 3,955,679 | 5/1976 | Gebauer | 209/115 |
| 4,082,189 | 4/1978 | Cordes | 209/73 |
| 4,095,625 | 6/1978 | Marpe | 141/93 |
| 4,191,294 | 3/1980 | McGrath et al. | 209/135 |
| 4,252,493 | 2/1981 | Ilse | 414/573 |
| 4,303,502 | 12/1981 | Lacher | 209/3 |
| 4,909,930 | 3/1990 | Cole | 209/587 X |
| 4,969,494 | 11/1990 | Chefson | 141/93 |
| 5,116,486 | 5/1992 | Pederson | 209/12 |

FOREIGN PATENT DOCUMENTS 276631 3/1990 Fed. Rep. of Germany ... B07C 5/36

*Primary Examiner*—Robert P. Olszewski
*Assistant Examiner*—Boris Milef
*Attorney, Agent, or Firm*—Stoel Rives Boley Jones and Grey

[57] ABSTRACT

A passively vented rejected article chute (40) includes at least two vents (44, 45) extending downwardly into the chute to vent air in directions (50) safely away from sorting and conveying functions, thereby improving sorting effectiveness. Rejected articles (14) that include defects (24) are deflected by an air ejector module (30) into the vented chute and are directed downwardly past the vents to preventing the vents from being blocked. The vents, formed by panels (46, 48), are flared open at their outer ends (54, 56) to decrease the velocity of exhaust air as it passes upwardly through them. Reducing the exhaust air velocity allows small and/or light weight articles entrained in the exhaust air to fall back into the reject chute, thereby preventing spillage of the entrained articles.

20 Claims, 3 Drawing Sheets

METHOD AND APPARATUS FOR USING PASSIVE EXHAUST FOR PNEUMATIC SORTING SYSTEM

TECHNICAL FIELD

This invention relates to pneumatic sorting systems and in particular to a passive exhaust structure for venting ejection air from an ejection area of a pneumatic sorting system.

BACKGROUND OF THE INVENTION

Pneumatic sorting systems are employed in a variety of applications, including automated optical inspection and sorting equipments. Such pneumatic sorting systems for automated optical inspection and sorting equipment are described in U.S. application No. 07/890,967 of Datari for a "Hole Sorting System and Method" that is assigned to the assignee of this application.

FIG. 1 shows a prior art automatic inspection and sorting system 10 that is capable of inspecting and sorting, for example, raw or processed fruits or vegetables, wood chips, recycled plastics, and other similar articles.

In operation, a conveyor belt 12 carries articles 14 in a direction 16 through an inspection area 18 of a video camera 20. Video camera 20 delivers to a video signal processor 22 a video signal representing the optical characteristics of articles 14. Video signal processor 22 is programmed to identify particular characteristics of articles 14 such as, for example, color, shape, size, or the presence of defects. Articles 14 that include a defect 24 can thereby be separated from articles 14 that do not include a defect.

After articles 14 pass through inspection area 18, they are propelled along a trajectory 26 toward an acceptance conveyor belt 28 that carries acceptable articles to subsequent processing stations (not shown). Whenever video signal processor 22 determines from the video signal that an article 14 includes a defect 24, an ejection activation signal is delivered to a suitable one of multiple air ejection modules 30. In response to the ejection activation signal, the suitable ejection module 30 generates a blast of air 32 that deflects defective article 24 from trajectory 26 toward a reject chute 34. Typically, articles 24 are deflected into reject chute 34 where they are funneled toward a reject conveyor belt 36 for removal. Reject chute 34 is intended to reduce spillage of defective articles. However, a problem with prior art system 10 is that rapid sorting of large quantities of articles 24 typically requires frequent air blasts 32 that result in large quantities of compressed air flowing into the article sorting area. The resulting air flow is turbulent and can cause disruption of article flow along trajectory 26 and spillage of rejected articles that would otherwise be directed toward reject chute 34.

The problem is especially significant when sorting small, lightweight articles 24 such as plastic flakes, potato chips, or the like. The air turbulence tends to lift and carry such articles 24 out of defect chute 34 before they can fall onto reject conveyor belt 36.

Prior attempts at solving these problems include providing vents or exhausts by forming in reject chute 34 perforated metal screens or small punched louvers. The problem with such vents or exhausts is that small articles 24 tend to leak through the perforations or louvers, whereas larger articles 24 tend to block the perforations or louvers. In particular, U.S. Pat. No. 3,097,161 issued Jul. 9, 1963 for CAPSULE INSPECTION AND SEPARATION, U.S. Pat. No. 4,082,189 issued Apr. 4, 1978 for APPARATUS FOR SEPARATING FOOD ARTICLES FROM FIELD DEBRIS, and U.S. Pat. No. 4,191,294 issued Mar. 4, 1980 for an EMPTY CAPSULE EJECTOR all describe pneumatic sorting systems in which air is vented through screens, grids, or other similar structures.

Some prior pneumatic sorting systems employ active exhausts vented through generally open ducts. Such actively vented systems tend to draw defective articles away from the reject conveyor belt and into the exhaust system. In particular, U.S. Pat. No. 3,097,744 issued Jul. 16, 1963 for a QUALITATIVE PHOTOMETRIC MATERIALS SORTER, U.S. Pat. No. 3,179,247 issued Apr. 20, 1965 for a RANDOM STREAM MATERIALS SORTER, and U.S. Pat. No. 5,116,486 issued May 26, 1992 for an APPARATUS AND METHOD FOR SEPARATING RECYCLABLE WASTE all describe pneumatic sorting systems in which excess air is vented through a generally open duct.

Other prior active venting devices of types not used in sorting systems are described in U.S. Pat. No. 3,405,820 issued Oct. 15, 1968 for DUST PROOF HOPPER and U.S. Pat. No. 3,908,720 issued Sep. 30, 1975 for CONTROL OF DUST DURING DISCHARGE OF MATERIALS INTO HOPPERS. These patents describe hoppers with associated chambers through which dust is actively exhausted from materials discharged into the hoppers. In particular, U.S. Pat. No. 3,405,820 shows in FIG. 4 a duct between an outer shell 2 and an inner shell 3 having an inner-facing lower lip (unnumbered), and U.S. Pat. No. 3,908,720 shows in FIG. 2 how dust is exhausted through apertures 6 and 7 into an inclined chamber 5.

A prior passive venting device of a type not used in a sorting system is described in U.S. Pat. No. 4,969,494 issued Nov. 30, 1990 for a FILTERING DEVICE and shows a generally conical structure for removing dust from air or other gas. As shown in FIG. 1, the device includes successive inclined conical chambers through which the gas passes while allowing the dust or other particulates to fall away. The gas flows in a serpentine manner through each of the chambers along both sides of the defining baffle and is eventually vented through a screen 13.

What is needed, therefore, is a pneumatic sorting system that passively removes air from the sorting area in such a manner that small, lightweight articles can be properly sorted without disrupting the sorting trajectory or causing article spillage.

SUMMARY OF THE INVENTION

An object of this invention is, therefore, to provide a defective article reject chute for a pneumatic sorting system.

Another object of this invention is to provide such a reject chute having a passive exhaust system to decrease turbulence that interferes with a proper sorting function.

A further object of this invention is to provide a reject chute having a passive exhaust system that prevents articles from exiting the chute with the exhaust.

Still another object of this invention is to provide a reject chute having a passive exhaust system that will not become blocked by rejected articles.

Accordingly, this invention provides a passively vented reject article chute that includes at least two vents extending downwardly into the chute for venting air in directions safely away from sorting and conveying functions. Rejected articles deflected into the reject chute by an ejector module are directed downwardly past the vents, thereby preventing the vents from being blocked. The vents are flared open at their outer ends to decrease the velocity of exhaust air as it passes upwardly through them. Reducing the exhaust air velocity allows small and/or light weight articles entrained in the exhaust air to fall back into the reject chute, thereby preventing spillage of the entrained articles.

Additional objects and advantages of this invention will be apparent from the following detailed description of a preferred embodiment thereof that proceeds with reference to the accompanying drawings.

DETAILED DESCRIPTION OF PREFERRED EMBODIMENT

Figure 1:
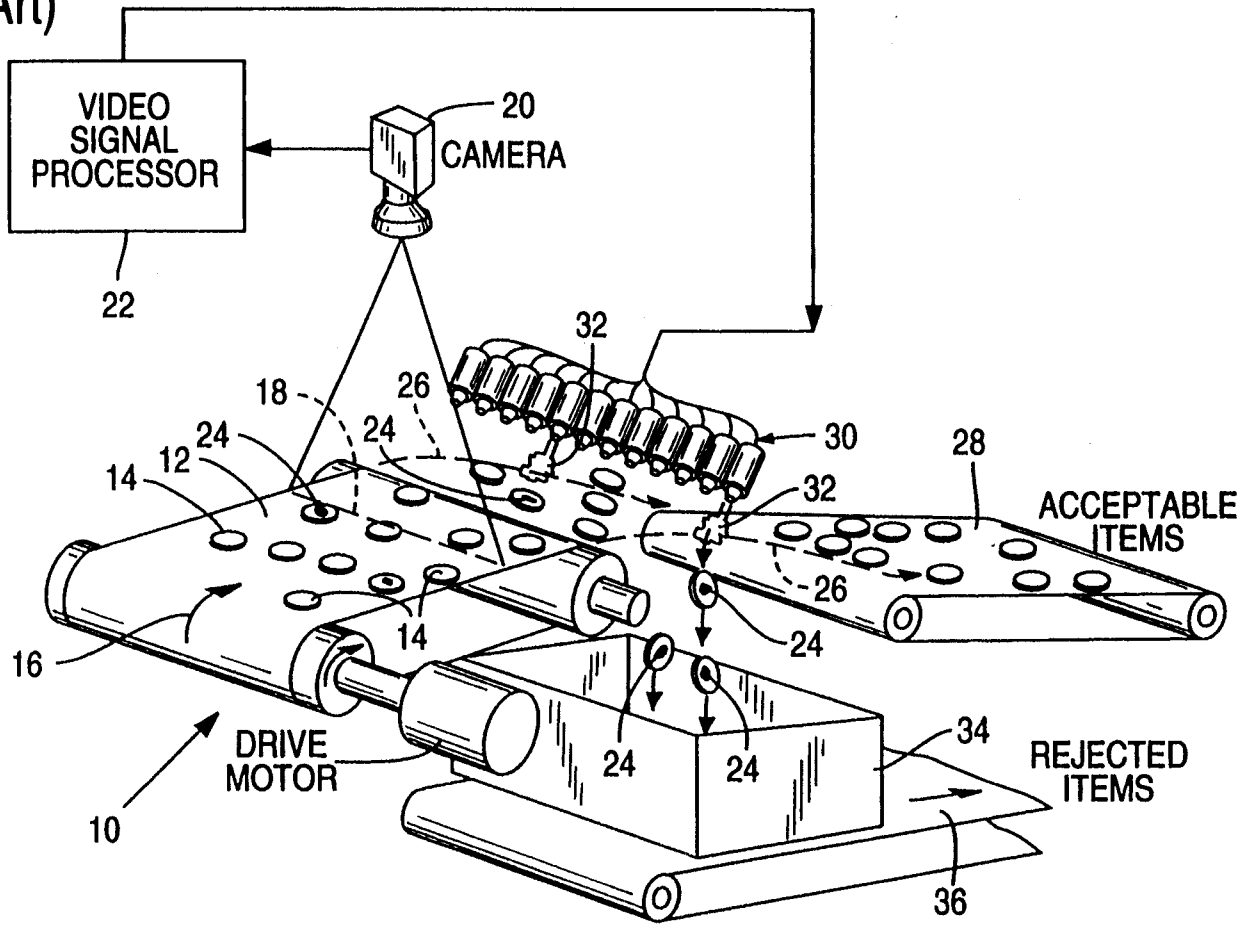
FIG. 1 (Prior Art)
FIG. 1 is a simplified isometric schematic pictorial diagram of a prior art automatic inspection and sorting system employing a pneumatic ejection system, reject chute, and reject conveyor belt.
Figure 2:
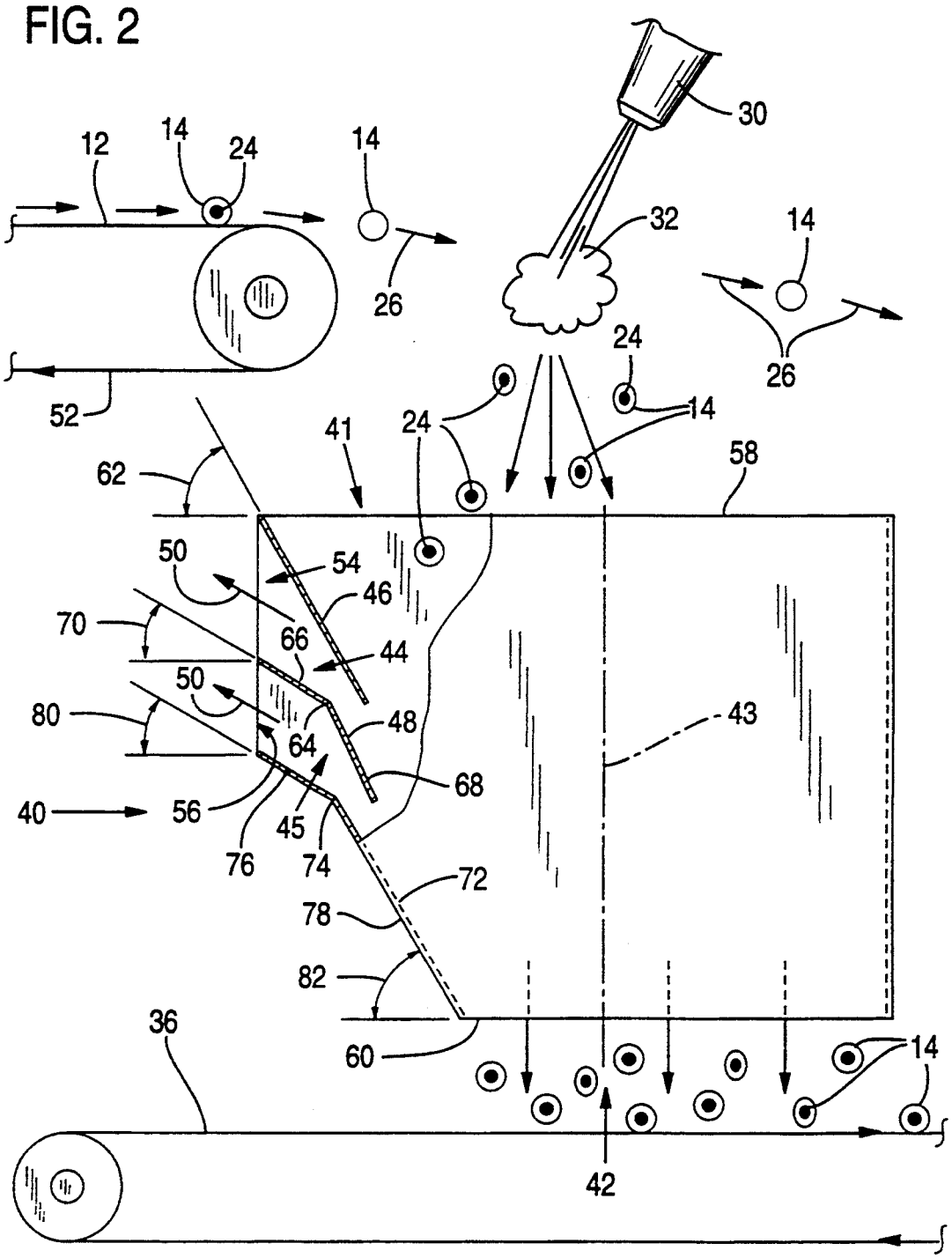
FIG. 2 is a simplified schematic pictorial side elevation view of a pneumatic sorting system employing a vented defective article chute shown partly cut away to reveal vent-forming panels.

FIG. 2 shows an inspection system 10 having a passively vented chute 40 according to this invention. Passive venting requires no active air motion-inducing devices such as blowers, pumps, vacuum motors, or the like in order to provide the desired exhaust function.

Vented chute 40 is generally rectangular in cross-section and has an open top 41 and an open bottom 42 through which a central longitudinal axis 43 extends. Vented chute 40 further includes at least two major vents 44 and 45 formed with panels 46 and 48 extending downwardly into vented chute 40. As a result, air from ejection modules 30 is vented in directions indicated by arrows 50 away from trajectory 26 and safely toward a return section 52 of conveyor belt 12.

A benefit of panels 46 and 48 is that rejected articles 12 deflected into vented chute 40 by an ejector module 30 are directed downwardly past vents 44 and 45, thereby preventing vents 44 and 45 from being blocked. Another feature of vents 44 and 45 is that they are flared open at their outer ends 54 and 56 to decrease the velocity of exhaust air as it passes upwardly through vents 44 and 45. Reduction in the exhaust air velocity allows articles 14 entrained in the exhaust air to fall back into vented chute 40, thereby preventing spillage of the articles 14.

Angular details of panels 46 and 48 are revealed in the cut away portion of vented chute 40. Vented chute 40 has an upper margin 58 and a lower margin 60 that are each generally perpendicular to central longitudinal axis 43. Panel 46 extends downwardly into vented chute 40 from upper margin 58 at an angle 62 of about 60 degrees, preferably 61.2 degrees, relative to upper margin 58. Panel 48 is bent along a bend axis 64 (shown end on) to form an outer panel segment 66 and an inner panel segment 68. Outer panel segment 66 extends downwardly into vented chute 40 from the junction of outer ends 54 and 56 of vents 44 and 45 at an angle 70 of about 30 degrees, preferably 31.2 degrees, relative to upper margin 58. Inner panel segment 68 extends downwardly into vented chute 40 substantially parallel to panel 46.

Vented chute 40 further includes an angled side wall 72 that is bent along a bend axis 74 (shown end on) to form an upper wall segment 76 and a lower wall segment 78. Upper wall segment 76 extends downwardly at an angle 80 of about 30 degrees, preferably 31.2 degrees, relative to upper margin 58. Lower wall segment 78 extends downwardly at an angle 82 of about 60 degrees, preferably 61.2 degrees, relative to upper margin 58.

Figure 3:
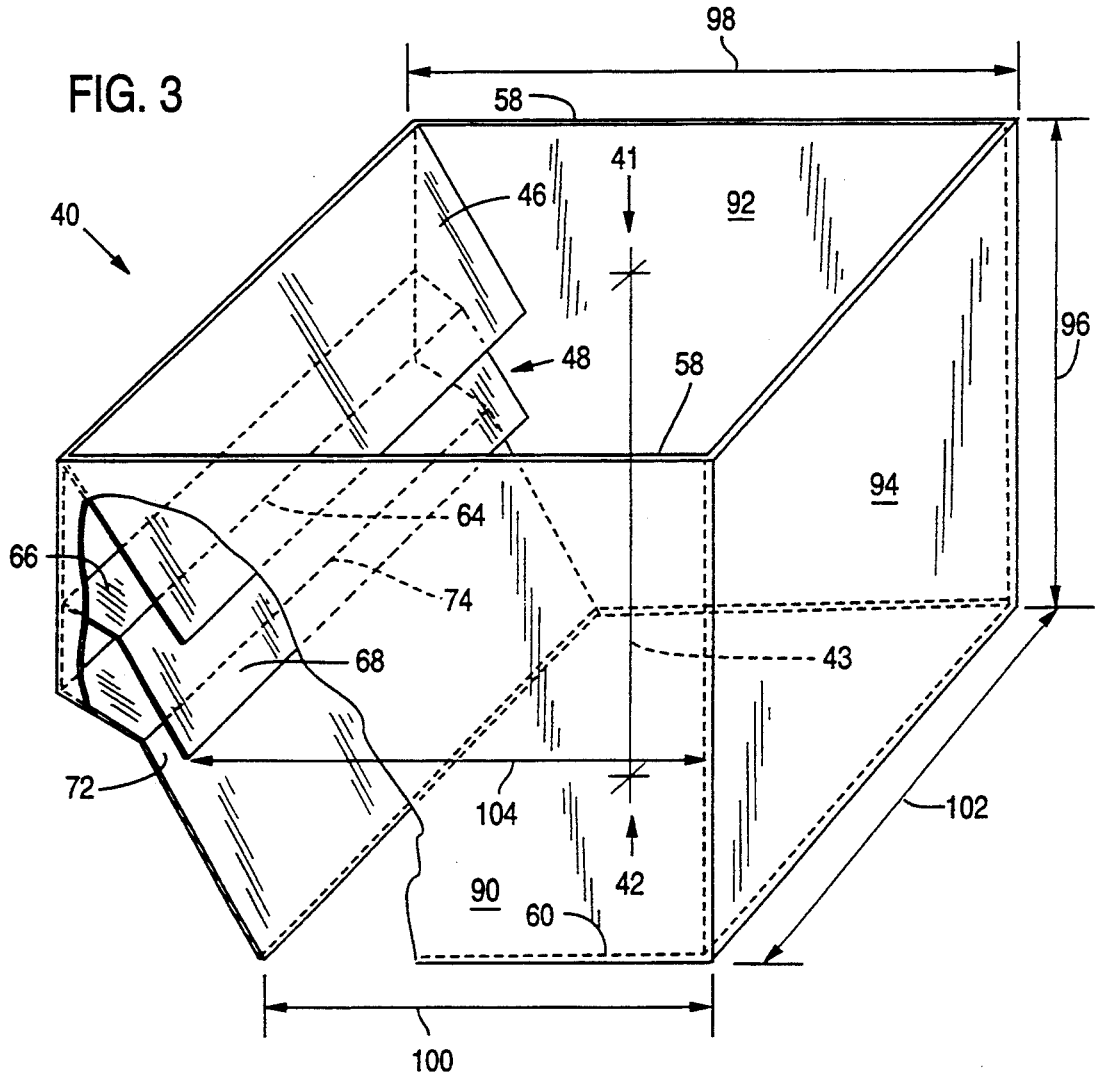
FIG. 3 is a simplified oblique pictorial view of the vented defective article chute of FIG. 2 shown partly cut away to reveal a preferred arrangement of the vent-forming panels.

FIG. 3 reveals a preferred arrangement of vent-forming panels 46 and 48 within vented chute 40. Major features shown in dashed lines include bend axis 64 of panel 48 and bend axis 74 of angled side wall 72. FIG. 3 shows that vented chute 40 further includes a pair of substantially parallel end walls 90 and 92 and a substantially vertical side wall 94. Vented chute 40 has a height 96 of about 33 centimeters, a width 98 at upper margin 58 of about 41 centimeters, a width 100 at lower margin 60 of about 28 centimeters, and a length 102 that depends on the number of air ejection modules 30 (FIG. 2) in a particular sorting system. A preferred sorting system has 192 air ejection modules 30 arranged in a line and spanning a width of 123 centimeters. Length 102 is, therefore, preferably 140 centimeters. Panels 46 and 48 are separated from vertical side wall 94 by a distance 104 of about 33 centimeters.

Skilled workers will recognize that portions of this invention may vary from those of the above-described preferred embodiment. For example, a gas other than air may be used to eject articles, more than two vents may be employed in vented chute 40, and the vents may exhaust gas to any combination of sides or ends of a vented chute. Panel 48 and angled side wall 72 may be curved rather than bent, and the above-described angles and dimensions are merely representative of the preferred embodiment and may be adapted to suit a particular sorting application. Of course, vented chute 40 may lead to a reject collection area other than a conveyor belt and may carry other than rejected articles.

It will be obvious to those having skill in the art that many changes may be made to the details of the above-described embodiment of this invention without departing from the underlying principles thereof. Accordingly, it will be appreciated that this invention is also applicable to chute venting applications other than those found in pneumatic sorting systems. The scope of this invention should be determined, therefore, only by the following claims.

We claim:

1. In a sorting system in which acceptable and unacceptable articles are conveyed past a video scanning camera that sends video data to a video signal processor for actuating selected combinations of multiple pneumatic ejection modules to deflect with an ejection gas unacceptable articles toward a reject collection area, an improvement comprising:

a generally tubular chute having open input and output ends through which a substantially vertical longitudinal axis extends and the deflected unacceptable articles fall while entrained in the ejection gas, the chute defined by opposed walls at least one of which includes a vent opening; and a first vent formed by vent-forming panels positioned in the vent opening and angled outwardly from the longitudinal axis to form a flared open vent passageway through which the ejection gas is exhausted at a velocity that diminishes toward an outer end thereof such that unacceptable articles are not exhausted together with the ejection gas.

2. The system of claim 1 in which the ejection gas is air.

3. The system of claim 1 in which the reject collection area comprises a conveyor belt.

4. The system of claim 1 in which the acceptable and the unacceptable articles are conveyed past the video scanning camera by a conveyor belt and the vent exhausts the ejection gas in a direction generally toward the conveyor belt.

5. The sorting system of claim 1 in which the tubular chute has an elongated rectangular configuration and the walls comprise opposed side walls and opposed end walls.

6. The sorting system of claim 1 in which the vent-forming panels are each angled outwardly from the longitudinal axis at an angle between 25 degrees and 65 degrees.

7. The sorting system of claim 5 in which the side wall has the vent opening, wherein said opening is angled outwardly from the longitudinal axis to form with one of the vent-forming panels a second vent positioned adjacent to and below the first vent.

8. The sorting system of claim 7 in which the side wall having the vent opening is angled outwardly from the longitudinal axis at an angle between 25 degrees and 65 degrees.

9. The sorting system of claim 7 in which one of the panels further includes a bend axis along which the panel is bent to form inner and outer panel segments each of which is angled outwardly from the longitudinal axis, the outer panel segment being angled outwardly at an angle greater than the inner panel segment such that the first and second vents both include a flared open vent passageway.

10. The sorting system of claim 7 in which the side wall having the vent opening further includes a bend axis along which the side wall is bent to form upper and lower wall segments each of which is angled outwardly from the longitudinal axis, the upper wall segment being angled outwardly at an angle greater than the lower wall segment such that the second vent includes a flared open vent passageway.

11. In a sorting system in which acceptable and unacceptable articles are conveyed past a video scanning camera that sends video data to a video signal processor for actuating selected combinations of multiple pneumatic ejection modules to deflect with an ejection gas unacceptable articles toward a reject collection area, an improvement comprising:

an elongated rectangular chute through which the deflected unacceptable articles fall while entrained in the ejection gas, the chute defined by mutually facing side walls held apart by mutually facing end walls and having an open top and an open bottom through which a central longitudinal axis extends, at least one of the side walls angled outwardly from the longitudinal axis at a first acute angle, the side walls and end walls joined together along at least part of their respective side margins such that the open top has a larger cross-sectional area than the open bottom; and first and second vent-forming panels suspended between the end walls and above the outwardly angled side wall, the vent-forming panels angled outwardly from the longitudinal axis at respective second and third acute angles to form first and second vents that exhaust ejection gas from the chute, each vent having an inner opening and an outer opening that has a greater cross-sectional area than the inner opening such that the vents are flared open to reduce an exhaust gas velocity at the outer openings thereof to prevent the entrained articles from being carried through the vents with the exhausted ejection gas.

12. The system of claim 11 in which the ejection gas is air.

13. The system of claim 11 in which the reject collection area comprises a conveyor belt.

14. The system of claim 11 in which the acceptable and the unacceptable articles are conveyed past the video scanning camera by a conveyor belt and the vent exhausts the ejection gas in a direction generally toward the conveyor belt.

15. The sorting system of claim 11 in which the first vent-forming panel is angled outwardly from the longitudinal axis at an angle between 25 degrees and 45 degrees and the second vent-forming panel is angled outwardly from the longitudinal axis at an angle between 45 degrees and 65 degrees.

16. The sorting system of claim 11 in which the outwardly angled side wall is angled outwardly from the longitudinal axis at an angle between 25 degrees and 65 degrees.

17. The sorting system of claim 11 in which one of the panels further includes a bend axis along which the panel is bent to form inner and outer panel segments each of which are angled outwardly from the longitudinal axis, the outer panel segment being angled outwardly at an angle greater than the inner panel segment such that the first and second vents both include a flared open vent passageway.

18. The sorting system of claim 11 in which the outwardly angled side wall further includes a bend axis along which the side wall is bent to form upper and lower wall segments each of which is angled outwardly from the longitudinal axis, the upper wall segment being angled outwardly at an angle greater than the lower wall segment such that the second vent includes a flared open vent passageway.

19. In a sorting system in which acceptable and unacceptable articles are conveyed past a video scanning camera that sends video data to a video signal processor for actuating selected combinations of multiple air ejection modules to deflect with ejection air unacceptable articles toward a reject collection area, a method of sorting small and/or light weight articles, comprising the steps of:

providing a substantially vertical tubular chute having an open top into which the unacceptable articles are deflected while entrained in the ejection air;

forming vents in the chute with vent-forming panels downwardly angled to direct the unacceptable articles through an open bottom in the chute;

flaring the vents open such that ejection air is exhausted upwardly through the vents at a velocity insufficient to lift unacceptable articles up and through the vents with the ejection air; and positioning the reject collection area immediately below the open bottom of the chute to collect the unacceptable articles with a minimum of spillage.

20. The method of claim 19 in which the ejection air creates a region of turbulence adjacent to the open top of the chute that reduces sorting effectiveness, the method further including the steps of:

propelling the conveyed articles along a trajectory through the region of turbulence toward an acceptable article collection area;

exhausting the ejection air through the vents at a volume sufficient to minimize the region of turbulence such that the article trajectory is not disturbed and the sorting effectiveness is restored.

* * * * *